US007013616B1

(12) United States Patent
Powers et al.

(10) Patent No.: US 7,013,616 B1
(45) Date of Patent: Mar. 21, 2006

(54) METHOD OF MAKING AND POSITIONING A SLEEVE ASSEMBLY

(75) Inventors: David M. Powers, Jackson, TN (US); John T. Holladay, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/052,412

(22) Filed: Feb. 7, 2005

Related U.S. Application Data

(62) Division of application No. 10/301,213, filed on Nov. 20, 2002, now Pat. No. 6,892,882.

(60) Provisional application No. 60/403,133, filed on Aug. 13, 2002.

(51) Int. Cl.
*B65B 11/00* (2006.01)
*B65B 51/08* (2006.01)

(52) U.S. Cl. ..... 53/397; 53/399; 53/410; 53/411; 53/413; 53/414; 53/416

(58) Field of Classification Search ..... 53/139.4, 53/138.6, 138.1, 134.1, 580, 416, 414, 413, 53/411, 410, 399, 397, 462, 208
See application file for complete search history.

(56) References Cited

U.S. PATENT DOCUMENTS

| | | | | | |
|---|---|---|---|---|---|
| 2,001,476 | A * | 5/1935 | Vogt | 426/110 |
| 2,106,276 | A * | 1/1938 | Heineman | 206/499 |
| 2,908,121 | A * | 10/1959 | Enos, Jr. | 53/399 |
| 2,911,096 | A * | 11/1959 | Andre | 206/434 |
| 3,411,696 | A * | 11/1968 | Ayer et al. | 206/525 |
| 3,861,530 | A * | 1/1975 | Calvert | 206/499 |
| 4,030,661 | A * | 6/1977 | Farquhar | 229/117.15 |
| 5,199,243 | A * | 4/1993 | Vlasaty et al. | 53/410 |
| 5,201,412 | A * | 4/1993 | Schuster et al. | 206/153 |
| 5,310,051 | A * | 5/1994 | Sutherland | 206/153 |
| 5,411,138 | A * | 5/1995 | Klawiter | 206/459.1 |
| 5,451,282 | A * | 9/1995 | Fore | 156/212 |
| 5,600,937 | A * | 2/1997 | Erickson et al. | 53/397 |
| 5,611,431 | A * | 3/1997 | Harris | 206/434 |
| 5,772,039 | A * | 6/1998 | Orr et al. | 206/779 |
| 6,105,774 | A * | 8/2000 | Jackson | 206/434 |
| 6,848,573 | B1 * | 2/2005 | Gould et al. | 206/141 |

* cited by examiner

*Primary Examiner*—Stephen F. Gerrity
(74) *Attorney, Agent, or Firm*—Suiter West Swantz pc llo

(57) ABSTRACT

A sleeve assembly is provided for a package. The package provides storage for a variety of items. A sleeve at least partially surrounds the package and connects to the package through a connection point. The sleeve includes a reinforced adhesive material which provides reinforcement to the connection point and prevents both tearing of the sleeve and displacement of the sleeve from the package.

20 Claims, 12 Drawing Sheets

METHOD OF MAKING AND POSITIONING A SLEEVE ASSEMBLY

CROSS-REFERENCE TO RELATED APPLICATIONS

The present application is a division of U.S. patent application Ser. No. 10/301,213, filed Nov. 20, 2002, now U.S. Pat. No. 6,892,882; which claims priority to U.S. provisional application Ser. No. 60/403,133, filed Aug. 13, 2002. The U.S. patent application Ser. No. 10/301,213 and U.S. provisional application Ser. No. 60/403,133 are herein incorporated by reference in their entireties.

FIELD OF THE INVENTION

The present invention generally relates to the field of packaging, and particularly to a packaging sleeve including reinforced tape.

BACKGROUND OF THE INVENTION

Paperboard and other similar materials are currently being used in a variety of packaging applications, such as packaging sleeves. Popular for the low production costs, ease of product name branding, and recycling value, these packaging sleeves are common in the marketplace. The packaging sleeves are often connected to the packages they encompass. Unfortunately, the connection points between the sleeves and the packages often tear during the process of getting the package from the manufacturer to the retailer and ultimately the consumer. Tearing may cause the sleeve to fall off the package, resulting in problems identifying the contents of a particular package and a reduction in marketability to consumers. Over the course of multiple shipments such tearing may result in decreased sales and profitability for a company from a particular product.

Packaging products have been the focus of intense research and product development due to the almost universal applications the products are tasked to perform. Many improvements in the materials used for packaging, such as corrugated cardboard, plastic wraps, and the like, have increased the overall structural strength of the packaging. While these improvements have increased the overall structural strength of packaging products the improvements have not provided a solution to the tearing problem associated with the connection of a packaging sleeve to the package encompassed.

Therefore, it would be desirable to provide a sleeve with reinforced material proximal to the connection point of the sleeve to the package to prevent the tearing of the sleeve, preserving product identity, marketability, and sales opportunities.

SUMMARY OF THE INVENTION

Accordingly, the present invention is directed to a sleeve assembly providing reinforced material proximal to a connection point between a sleeve and a package. Loss of product identity and consumer satisfaction is avoided by the present invention which ensures that the sleeve, which at least partially surrounds the package, remains affixed to the package. For example, a blank package, which contains a circular saw, may include a sleeve identifying the type of circular saw and the manufacturer. If the sleeve were to tear and fall off, the receiver of the package may not know what they are receiving and may be inclined not to accept the package as a result. Such a situation may affect overall sales of the circular saw in the package, which may hurt business. In a first aspect of the present invention, a sleeve assembly is provided for a package. The package provides storage for a variety of items. A sleeve at least partially surrounds the package and connects to the package through a connection point. The sleeve includes a reinforced adhesive material which provides reinforcement to the connection point.

In a second aspect of the present invention, a reinforced sleeve assembly provides a sleeve including a segment of reinforced tape connected to the sleeve for reinforcing the connection point of the sleeve to a package, which the sleeve at least partially surrounds. The sleeve assembly further includes a fastener, which fastens the sleeve to the package through the connection point. By reinforcing the connection point, the sleeve is protected against the fastener tearing through the connection point which may result in the sleeve being removed from the package.

In a third aspect of the present invention a reinforced connection point on a sleeve assembly includes a piece of reinforced adhesive material connected to a sleeve proximal to a connection point on the sleeve. The sleeve assembly further includes a fastener, which fastens the sleeve to a package through the connection point. It has often been the case that during shipment of packages with sleeves the normal jostling and displacement of the packages may result in the tearing of the sleeve at the point the sleeve is connected to the package. Therefore, by reinforcing the connection point on the sleeve, the present invention, significantly reduces the chances of the sleeve tearing and being removed form the package it at least partially surrounds.

In a fourth aspect of the present invention a method for manufacturing a sleeve assembly with a reinforced connection point includes providing a continuous feed of paperboard; creating a connection point on the paperboard for connecting with a package; attaching a reinforced adhesive material to the paperboard in a selective location proximal to the connection point; scoring the paperboard to form a sleeve; and folding the paperboard, along the scoring, to form the sleeve.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
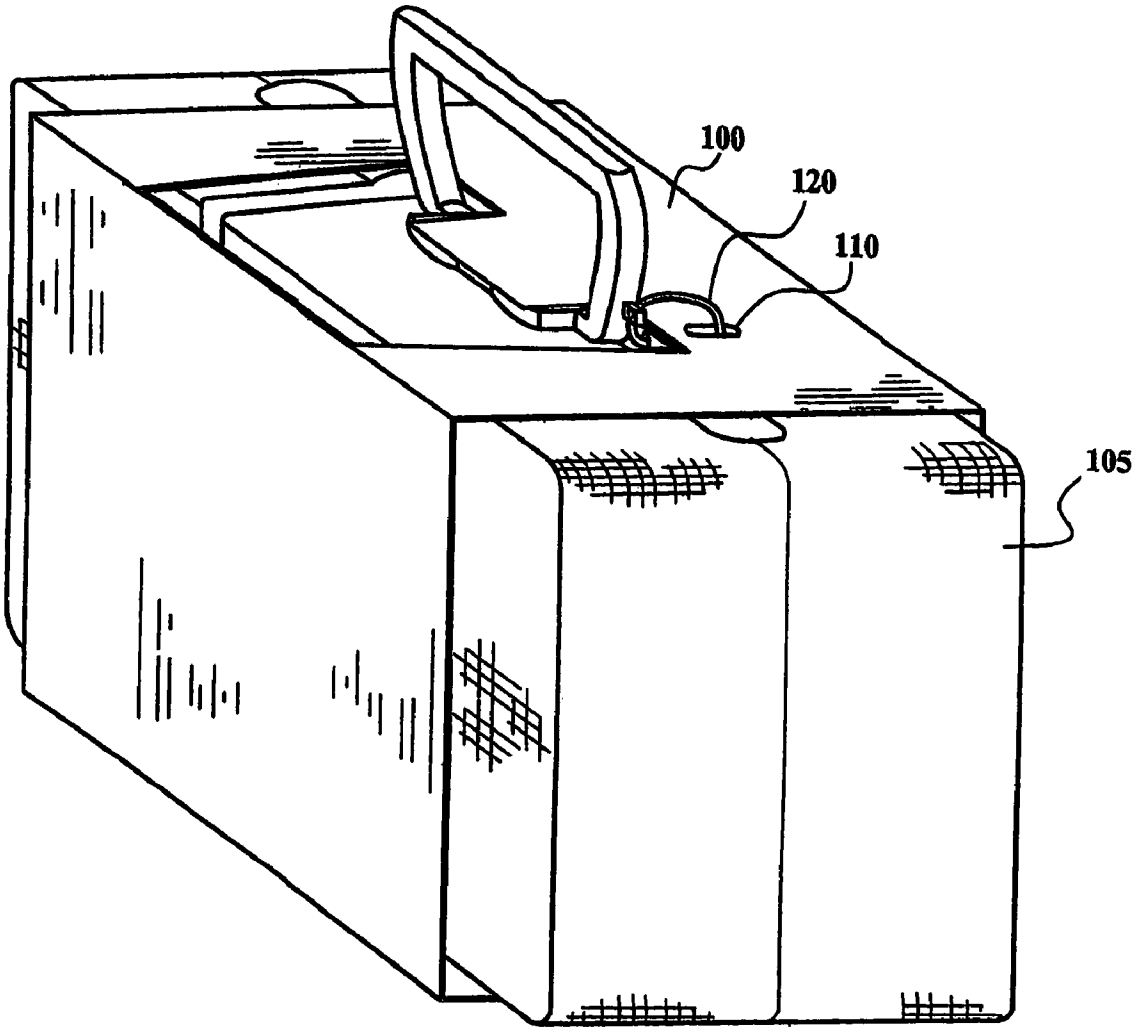
FIG. 1 is an isometric view illustrating a sleeve assembly partially surrounding a package and a fastener connecting the sleeve assembly to the package through a connection point in accordance with an exemplary embodiment of the present invention.
Figure 2:
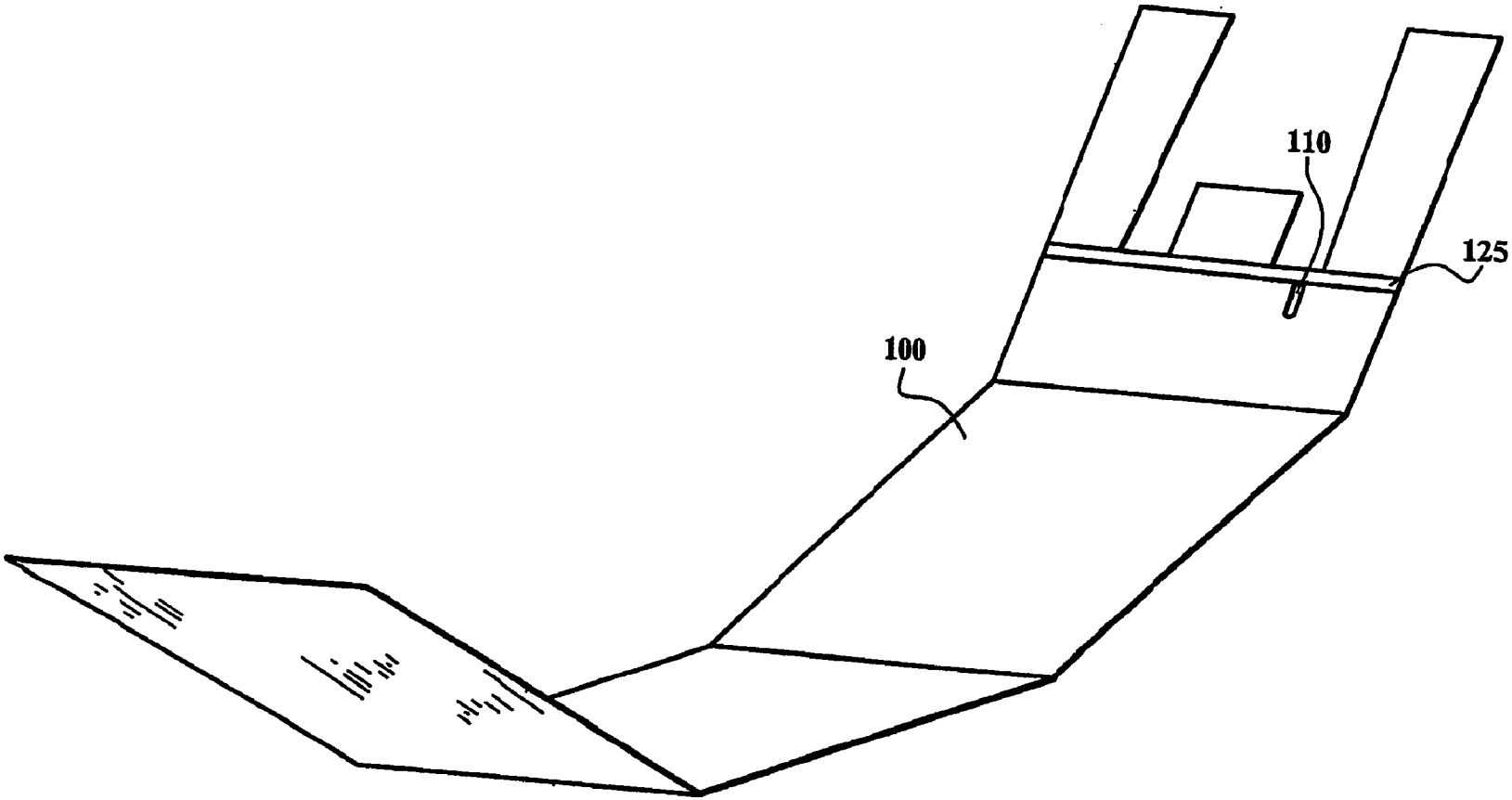
FIG. 2 is an isometric view of the sleeve assembly illustrating a first reinforced adhesive material connected to the sleeve assembly, proximally to the connection point.
Figure 3:
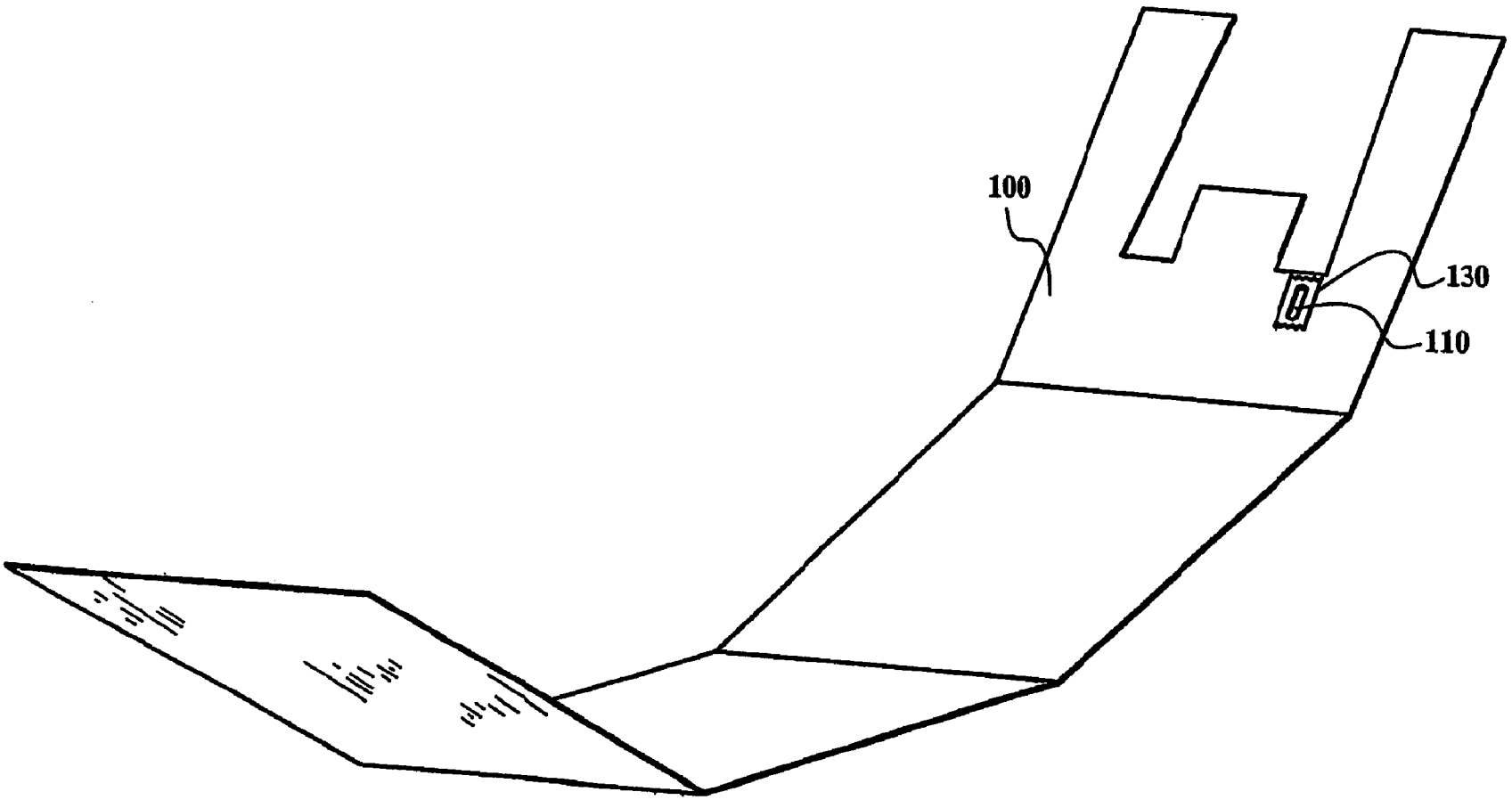
FIG. 3 is an isometric view of the sleeve assembly illustrating a second reinforced adhesive material connected to the sleeve proximal to the connection point.
Figure 4:
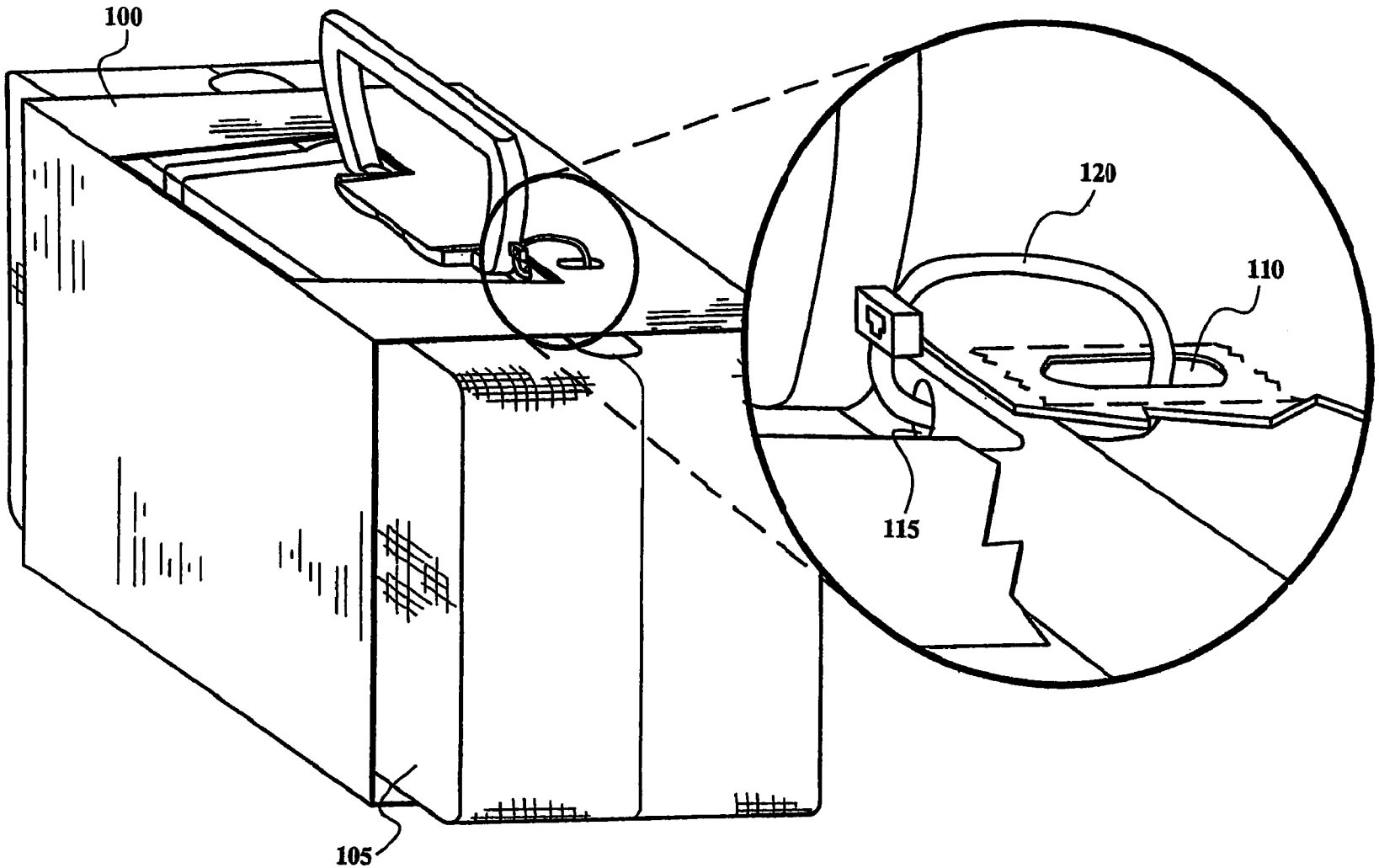
FIG. 4 is an exploded view illustrating the fastener connecting the sleeve assembly to the package through the connection point and outlining the location of a second reinforced adhesive material connected to the sleeve assembly in accordance with an exemplary embodiment of the present invention.

Referring generally now to FIGS. 1 through 12, exemplary embodiments of the present invention are shown. In FIGS. 1 through 4, sleeve assembly 100 is shown partially surrounding a package 105. A connection point 110 included on the sleeve assembly 100 lines up with a connection point 115 on the package 105. A fastener 120 connects the sleeve assembly 100 with the package 105 through connection points 110 and 115. Preferably, a reinforced adhesive material 125 is disposed across the length of the sleeve assembly 100 in a position to provide support to the connection point 110, as shown in FIG. 2. The reinforced adhesive material may comprise at least one of a piece of reinforced tape material, a piece of reinforced polyethylene coated material, or a piece of reinforced thermoplastic material. Alternately, the reinforced adhesive material may comprise a patch of reinforced adhesive material 130, as shown in FIGS. 3 and 4.

The current invention may provide manufacturers and retailers of a wide variety of consumer goods a mechanism to aid in preventing damage to sleeve assemblies. This is crucial as consumer opinion may be swayed by the overall appearance of a product and its encompassing sleeve assembly on a shelf. For instance, a consumer may take note of a product with a damaged sleeve and infer that the product itself has been mistreated or is unsuitable for purchase and select a product with an undamaged sleeve or another product. This loss of confidence in the product by the consumer may result in decreased sales and ultimately may have an affect on the perceived value of the product. The present invention may improve consumer confidence in a product on the shelves resulting in increased sales by providing a mechanism by which the appearance of a product may be maintained.

In the present embodiment, the fastener 120 comprises a plastic tie. The fastener 120 is of a size to fit through the connection points 110 and 115 located on the sleeve assembly 100 and the package 105. It is understood that other fastening mechanisms and different materials may be employed for the fastener 120 without departing from the scope and spirit of the present invention. The fastener 120 may comprise at least one of a pin, a tie, a hook, or a compression fastener.

Preferably, the package 105 is suitable for storage of tools, such as ratchet sets, saws, drills, wrenches, and the like. However, the package 105 may be employed as a storage device for a variety of items, such as food, clothing, toys, or the like. In the current embodiment, the package 105 is a rigid plastic container which includes a handle 130 for transportation. Further, the sleeve assembly 100 is cut to allow the handle 130 to be used without causing damage to the sleeve assembly 100.

Figure 5:
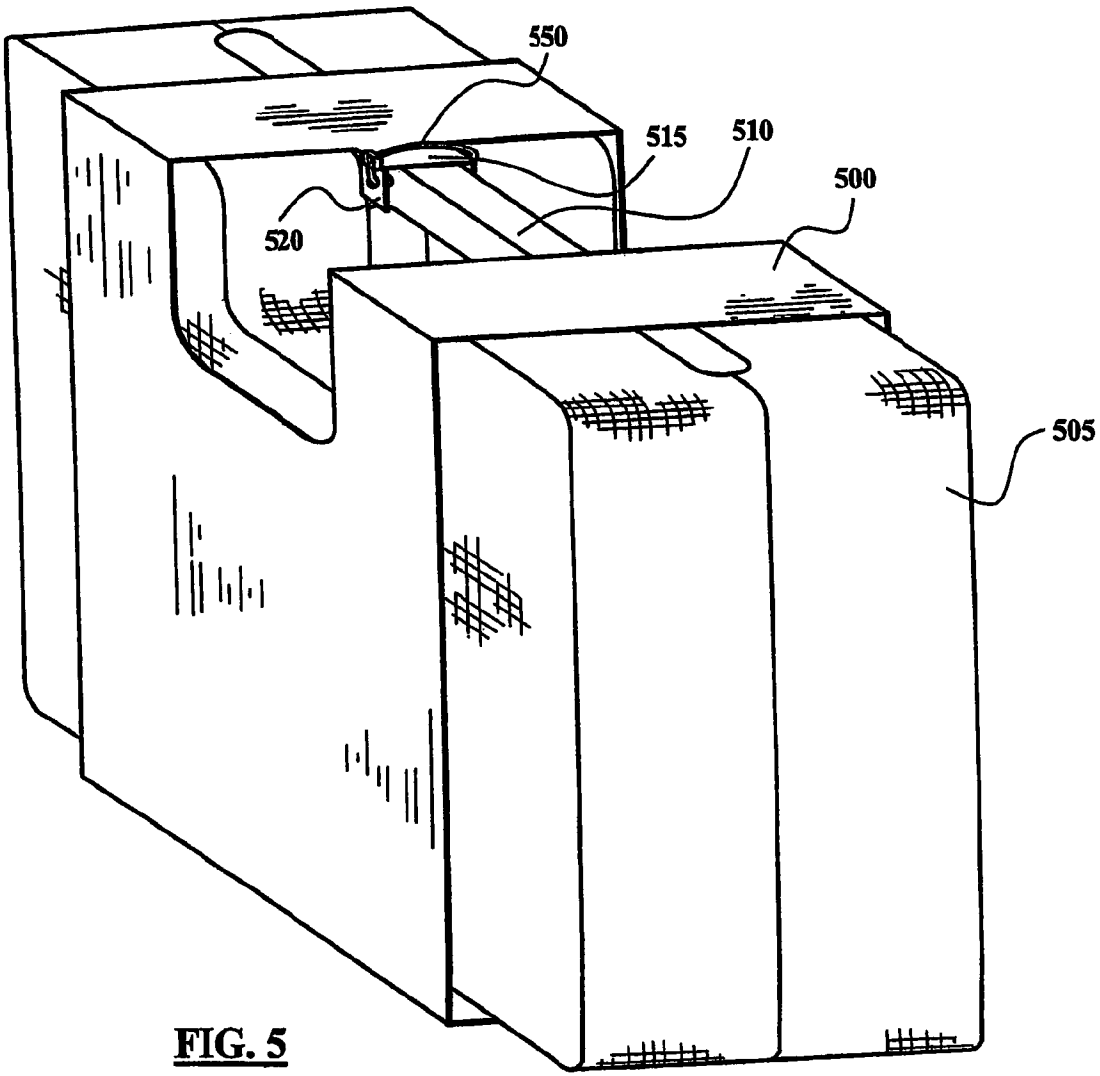
FIG. 5 is an isometric view illustrating a second sleeve assembly partially surrounding a package and a fastener connecting the second sleeve assembly to the package through a connection point in accordance with an exemplary embodiment of the present invention.
Figure 6:
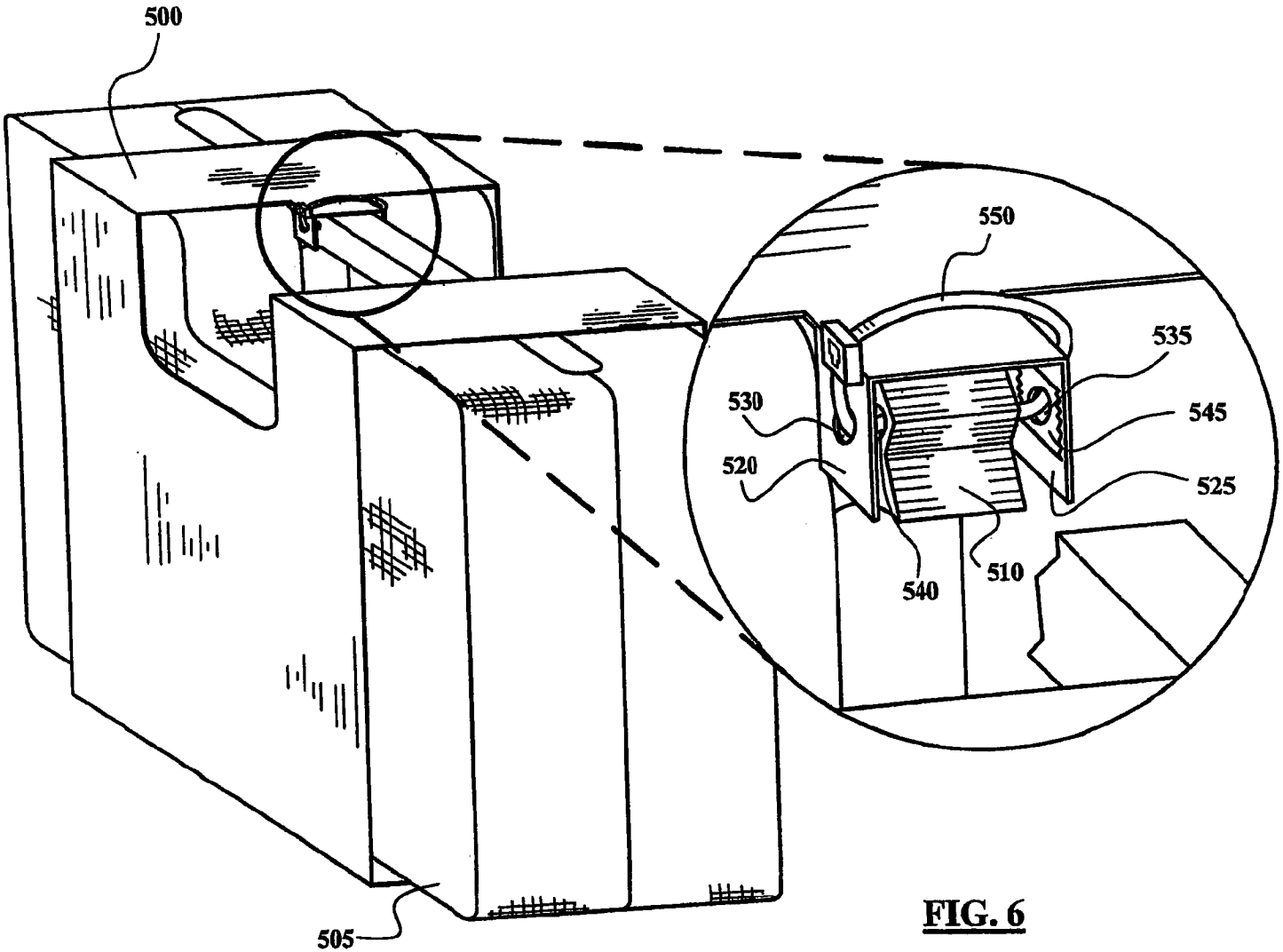
FIG. 6 is an exploded view illustrating the fastener connecting the second sleeve assembly to the package through the connection point and a reinforced adhesive material surrounding the connection point on the sleeve.
Figure 7:
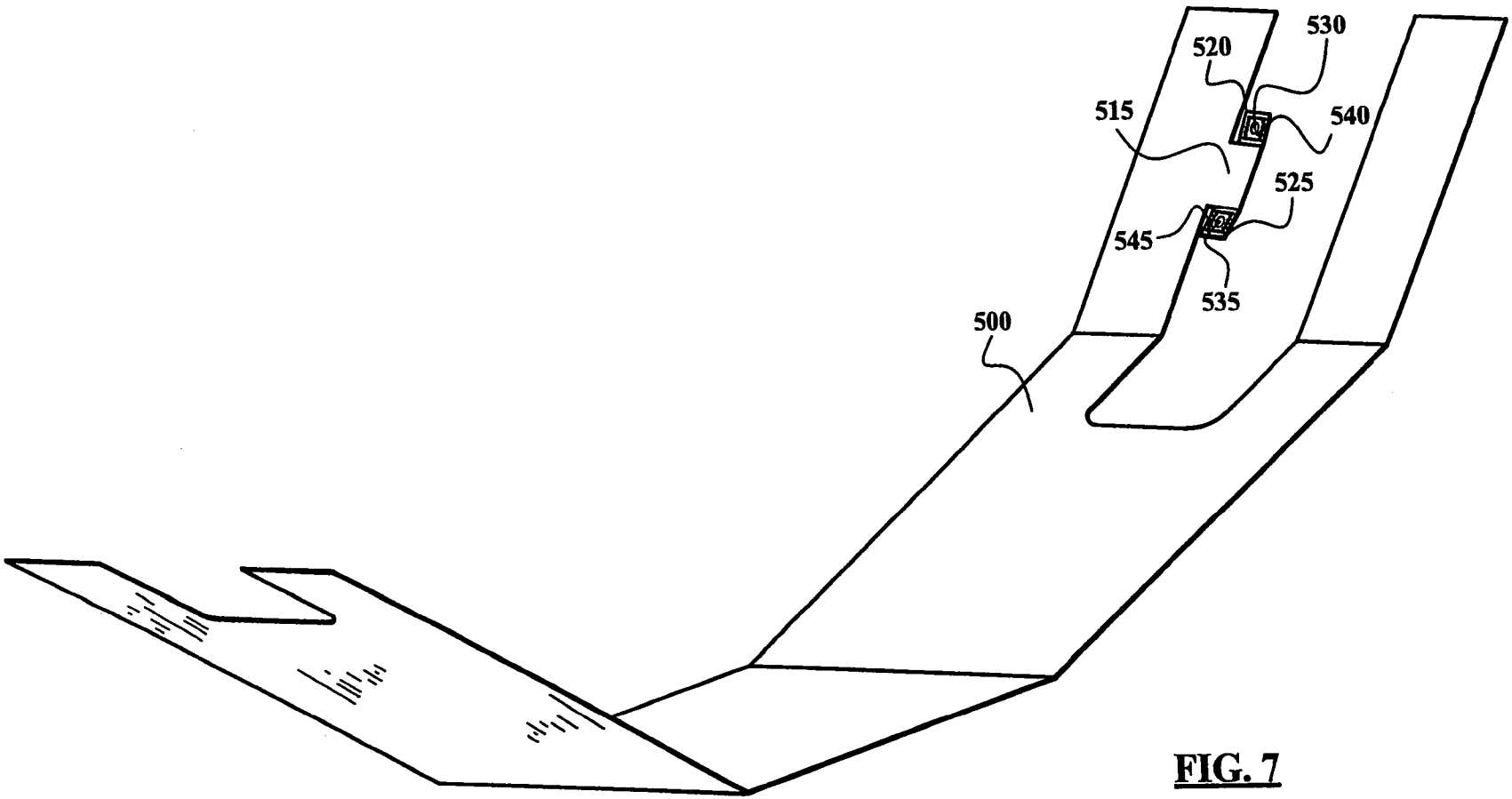
FIG. 7 is an isometric view of the second sleeve assembly illustrating the reinforced adhesive material connected to the sleeve proximal to the connection point.

An alternate embodiment of a sleeve assembly 500 is shown in FIGS. 5 through 7. The sleeve assembly 500 partially surrounds the package 505. The sleeve assembly 500 includes an extension 515 with a first flap 520 and a second flap 525, which bracket the handle 510, instead of a single connection point, as shown in FIGS. 1 through 4. Both flaps 520 and 525 include connection points 530 and 535 which line up with the connection point 540 included within handle 510. Surrounding each of the connection points 530 and 535 are patches of reinforced adhesive material 540 and 545. A fastener 550, similar to the fastener 120 described above, connects the sleeve assembly 500 to the package 505.

Figure 8:
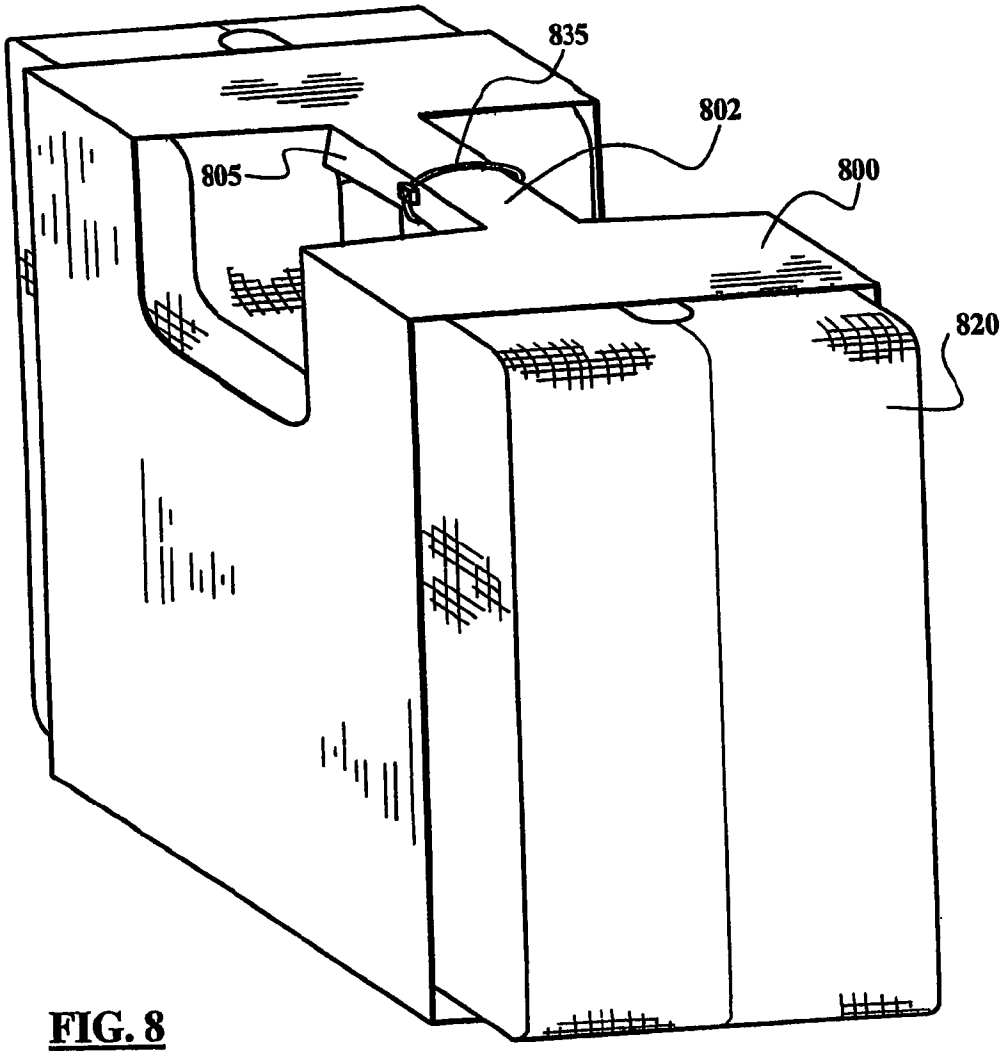
FIG. 8 is an isometric view illustrating a third sleeve assembly partially surrounding a package and a fastener connecting the third sleeve assembly to the package in accordance with an exemplary embodiment of the present invention.
Figure 9:
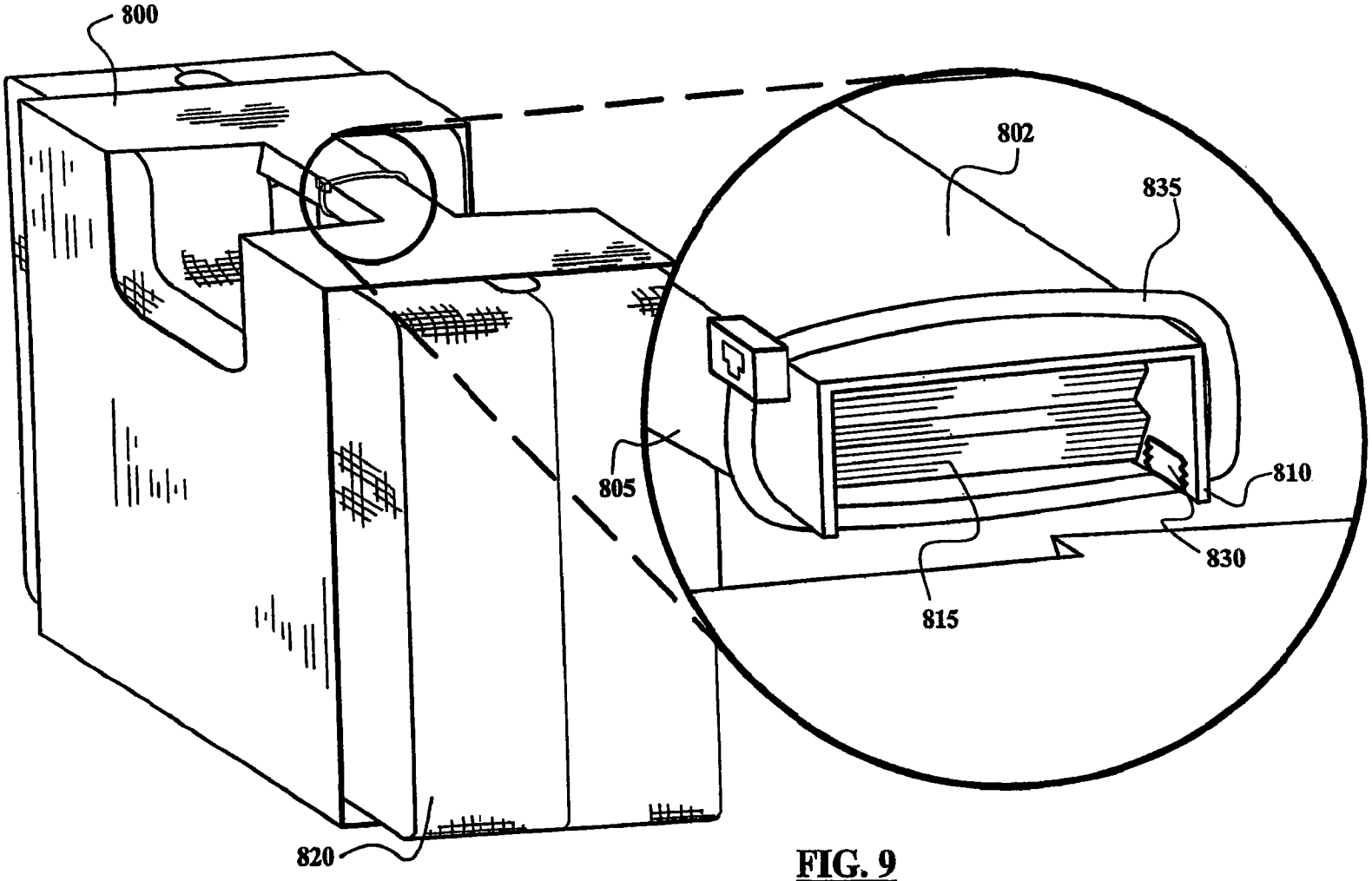
FIG. 9 is an exploded view illustrating the fastener connecting the third sleeve assembly to the package and showing the location of a reinforced adhesive material connected to the third sleeve assembly to prevent tearing of the sleeve by the fastener.
Figure 10:
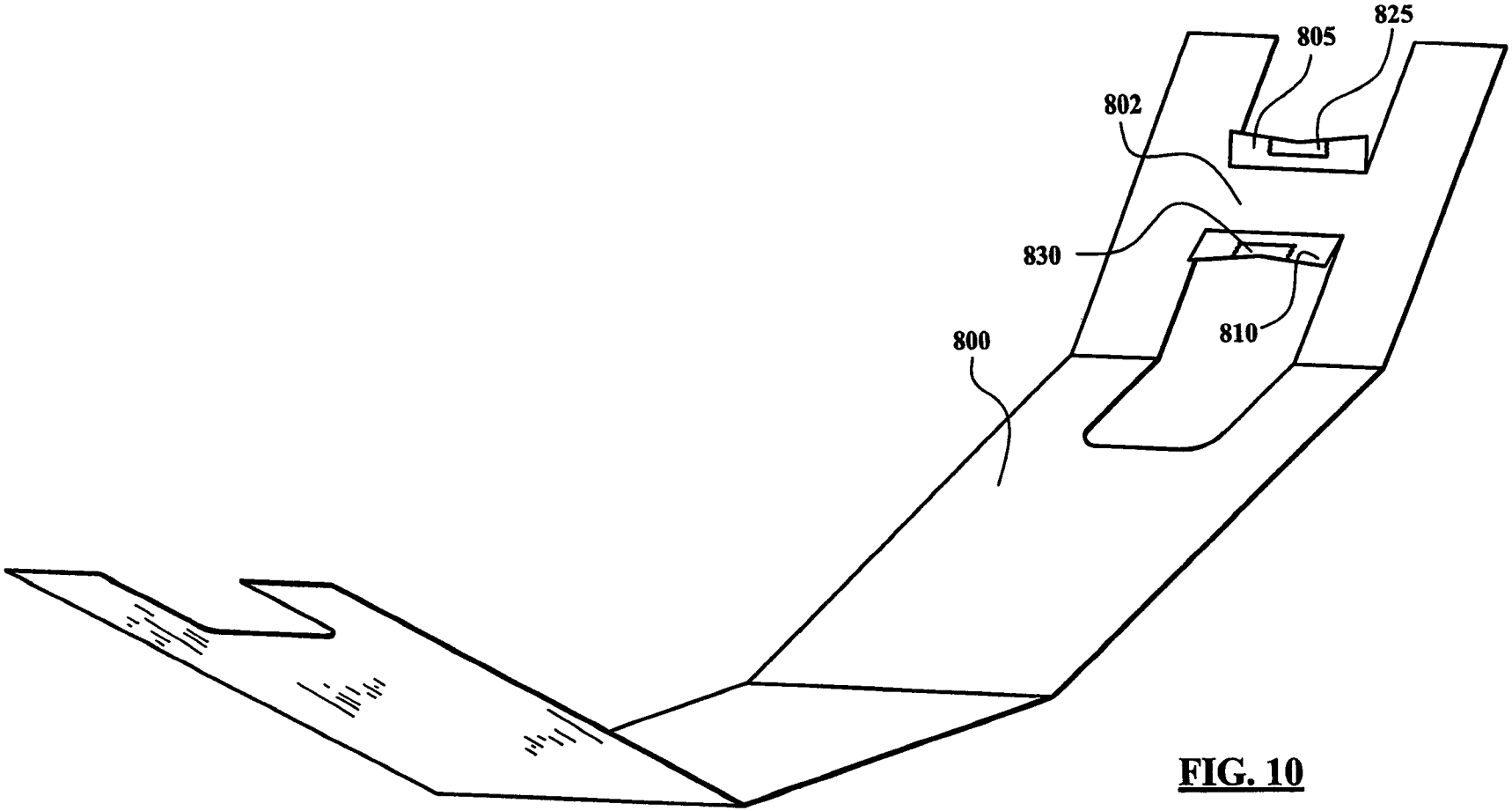
FIG. 10 is an isometric view of the third sleeve assembly illustrating the reinforced adhesive material connected to the sleeve proximal to the connection point.

In another embodiment, a sleeve assembly 800 includes a handle 802, as shown in FIGS. 8 through 10. The handle 802 includes a first flap 805 and a second flap 810 which fold down to either side of the handle 815 of the package 820. Preferably, a first piece of adhesive material 825 and a second piece of adhesive material 830 are connected to the flaps 805 and 810, as shown in FIG. 10. The sleeve assembly 800 partially surrounds the package 820. The handle 802 of the sleeve assembly 800 is connected to the handle 815 of the package 820 by use of a fastener 835. The fastener 835 is similar to fastener 120 described above in FIGS. 1 through 4. In this embodiment, the connection point is the location on the two flaps 805 and 810 where the reinforced adhesive material is situated. Thus, the fastener surrounds both the sleeve assembly 800 and the handle 815 of the package connecting the two together.

Figure 11:
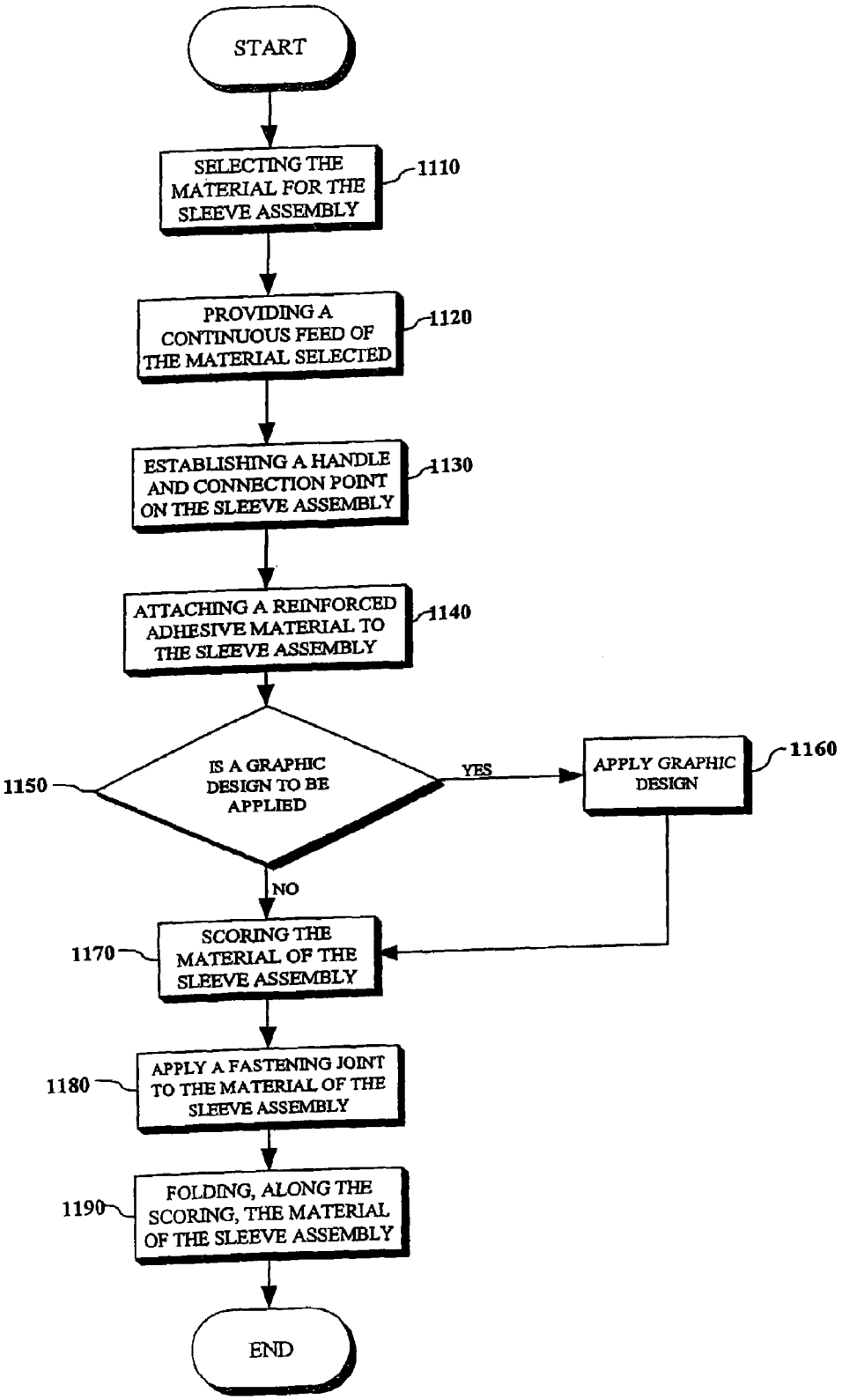
FIG. 11 is a flowchart illustrating a method of manufacturing a sleeve assembly in accordance with an exemplary embodiment of the present invention.

Referring now to FIG. 11, a method of manufacturing a sleeve assembly in accordance with an exemplary embodiment of the present invention is shown. The first step 1110 requires a user to select the material from which the sleeve assembly will be made. Preferably, paperboard, such as corrugated cardboard and the like, is selected as the material for the sleeve assembly. Alternately, the material selected may be plastic, metal, and the like. In step 1120, a continuous feed of the selected material is provided. Preferably, the continuous feed is connected to a machine which will perform the necessary operations upon the selected material to prepare individual sleeve assemblies. In step 1130, individual handles and connection points are established on each of the sleeve assemblies being produced. Preferably, the handles are merely cut-outs that allow the handle connected to the package around which the sleeve assembly attaches, to operate freely. After the connection point is established a reinforced adhesive material is attached to sleeve assembly in step 1140. The adhesive material is located proximally to the connection point to provide reinforcement to the connection point.

In step 1150 it is determined whether or not a graphic design is to be applied to the sleeve assembly. If a graphic design is to be applied then the manufacturing process, in step 1160 applies the graphic design. After the graphic design has been applied, in step 1160, or if it is determined that no graphic design is to be applied the manufacturing proceeds to step 1170. In step 1170 the material of the sleeve assembly is scored. It is understood that the pattern of scoring may vary as required by needs of the manufacturer and/or consumer. After the scoring is complete, in step 1180, a fastening joint is established on the material of the sleeve assembly. The fastening joint may be a variety of materials, such as glue, adhesive material, thermal bonding material, or the like. Upon completion of step 1180 the material of the sleeve assembly is folded along the score lines in step 1190 to form the finished sleeve assembly.

Figure 12:
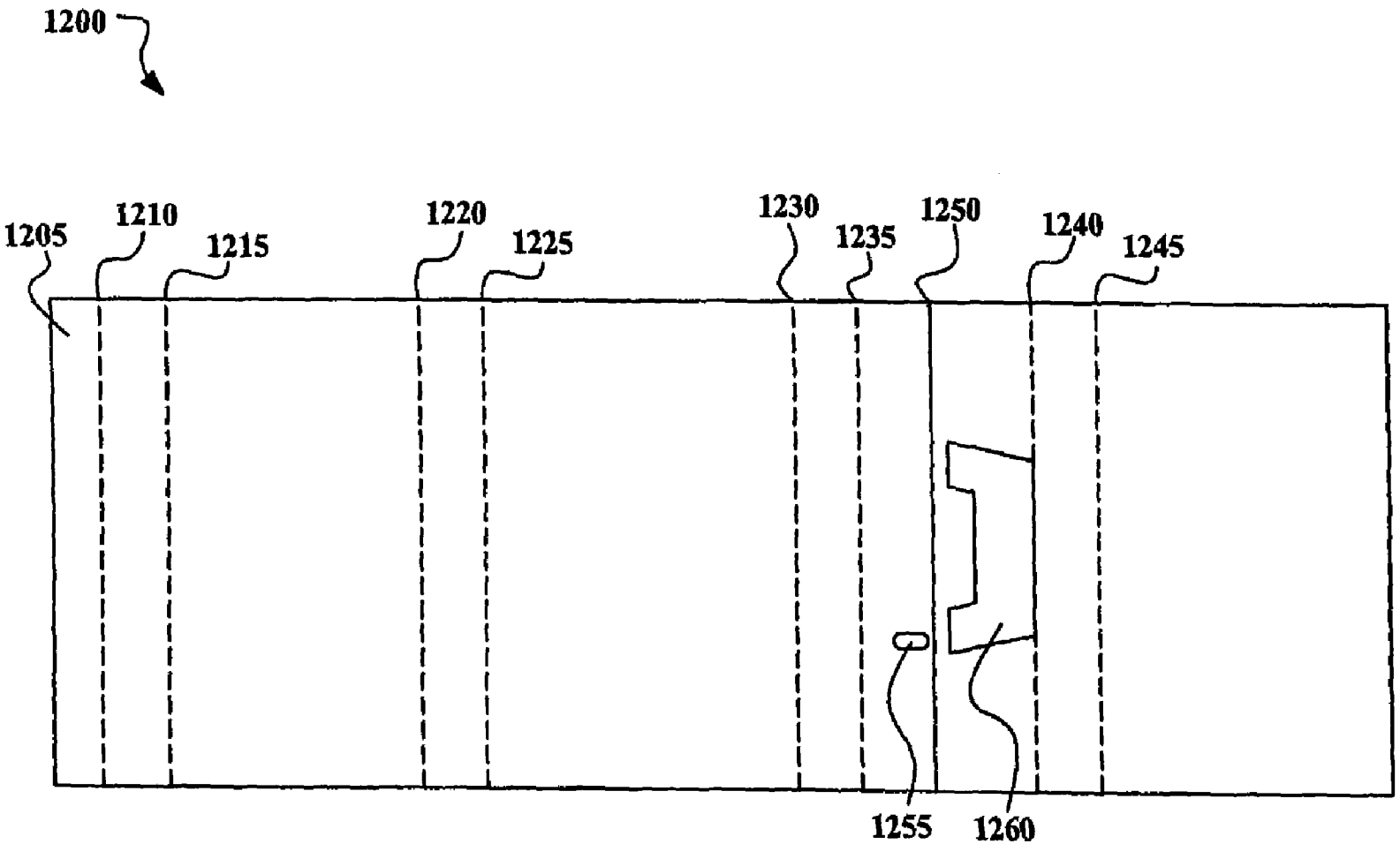
FIG. 12 is an illustration of the manufacturing of the first sleeve assembly, shown in FIGS. 1 through 4, including the scoring of the sleeve, insertion of a connection point, and connection of a reinforced adhesive material located proximally to the connection point in accordance with an exemplary embodiment of the present invention.

Referring now to FIG. 12, a manufactured sleeve assembly 1200 is shown. The sleeve assembly 1200 is similar to that described above in FIGS. 1 through 4. However, alternate embodiments, such as that shown in FIGS. 5 through 10 may be manufactured. The sleeve assembly 1200 is scored at a plurality of points 1210, 1215, 1220, 1225, 1230, 1235, 1240, and 1245, to facilitate forming the desired sleeve configuration. Preferably, the scoring is in accordance with the particular package around which the sleeve assembly is to be attached. Therefore, a plurality of scoring patterns may be used without departing from the scope and spirit of the present invention. A glue joint 1205 is included on the sleeve assembly 1200 to enable formation of the sleeve assembly 1200. It is understood that a variety of fastening systems and/or adhesive materials may be employed to form glue joint 1205. The reinforced adhesive material 1250 is located above the connection point 1255 but below the handle cut out 1260. As described in FIGS. 1 through 4, the current position of the connection point 1255 allows a fastener to connect the sleeve assembly 1200 with a package. The reinforced adhesive strip 1250 protects the sleeve assembly 1200 against tearing caused by the fastener during shipping and handling of the package. The location and configuration of the connection point 1255 as well as the adhesive strip 1250 may vary as contemplated by one of ordinary skill in the art. For example, the connection point 1255 may be located further from the handle cut out area and the adhesive strip may be a piece of adhesive material which immediately surrounds the connection point.

In the exemplary embodiments, the methods disclosed may be implemented as sets of instructions or software readable by a device. Further, it is understood that the specific order or hierarchy of steps in the methods disclosed are examples of exemplary approaches. Based upon design preferences, it is understood that the specific order or hierarchy of steps in the method can be rearranged while remaining within the scope and spirit of the present invention. The accompanying method claims present elements of the various steps in a sample order, and are not necessarily meant to be limited to the specific order or hierarchy presented.

It is believed that the sleeve design with reinforced tape of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A method of manufacturing and positioning a sleeve assembly at least partially around a package, comprising:

selecting a material to be used for the sleeve assembly;

providing a continuous feed of the material to be used for the sleeve assembly;

establishing a connection point on the sleeve assembly material and establishing a connection point on the package;

attaching a reinforced adhesive material to the sleeve assembly in a selective location proximal to the sleeve assembly connection point;

scoring the material of the sleeve assembly to form a sleeve assembly;

applying a fastening joint to the material of the sleeve assembly;

folding the material of the sleeve assembly, along the scoring;

positioning the sleeve assembly at least partially around the package; and connecting the sleeve assembly to the package using a fastener passing through the sleeve assembly connection point and the package connection point.

2. The method of claim 1, wherein the selecting of the material to be used for the sleeve assembly further comprises the step of selecting at least one of paperboard, plastic, or metal.

3. The method of claim 1, wherein the reinforced adhesive material comprises at least one of a piece of reinforced tape material, a piece of reinforced polyethylene coated material, or a piece of reinforced thermoplastic material.

4. The method of claim 1, wherein scoring the material of the sleeve assembly further comprises the step of scoring the material to include a handle on the sleeve assembly.

5. The method of claim 1, wherein the fastener is at least one of a pin, tie, hook, or compression fastener.

6. The method of claim 1, wherein the method further comprises the step of applying a graphic design to the material of the sleeve assembly after the attachment of the reinforced adhesive material.

7. The method of claim 1, wherein the fastening joint is at least one of a glue joint, thermal bonding material, or adhesive material.

8. A method of manufacturing and positioning a sleeve assembly at least partially around a package, comprising:

selecting a material to be used for the sleeve assembly;

providing a continuous feed of the material to be used for the sleeve assembly;

establishing a connection point on the sleeve assembly material and establishing a connection point on the package;

attaching a reinforced adhesive material to the sleeve assembly in a selective location proximal to the sleeve assembly connection point;

scoring the material of the sleeve assembly to form and to include a handle on the sleeve assembly;

applying a fastening joint to the material of the sleeve assembly;

folding the material of the sleeve assembly, along the scoring;

positioning the sleeve assembly at least partially around the package; and connecting the sleeve assembly to the package using a fastener passing through the sleeve assembly connection point and the package connection point.

9. The method of claim 8, wherein the selecting of the material to be used for the sleeve assembly further comprises the step of selecting at least one of paperboard, plastic, or metal.

10. The method of claim 8, wherein the reinforced adhesive material comprises at least one of a piece of reinforced tape material, a piece of reinforced polyethylene coated material, or a piece of reinforced thermoplastic material.

11. The method of claim 8, wherein the fastener is at least one of a pin, tie, hook, or compression fastener.

12. The method of claim 8, wherein the method further comprises the step of applying a graphic design to the material of the sleeve assembly after the attachment of the reinforced adhesive material.

13. The method of claim 8, wherein the fastening joint is at least one of a glue joint, thermal bonding material or adhesive material.

14. A method of manufacturing and positioning a sleeve assembly at least partially around a package, comprising:

selecting a material to be used for the sleeve assembly;

providing a continuous feed of the material to be used for the sleeve assembly;

establishing a connection point on the sleeve assembly material and establishing a connection point on the package;

attaching a reinforced adhesive material to the sleeve assembly in a selective location proximal to the sleeve assembly connection point;

applying a graphic design to the material of the sleeve assembly;

scoring the material of the sleeve assembly to form a sleeve assembly;

applying a fastening joint to the material of the sleeve assembly;

folding the material of the sleeve assembly, along the scoring;

positioning the sleeve assembly at least partially around the package; and connecting the sleeve assembly to the package using a fastener passing through the sleeve assembly connection point and the package connection point.

15. The method of claim 14, wherein the selecting of the material to be used for the sleeve assembly further comprises the step of selecting at least one of paperboard, plastic, or metal.

16. The method of claim 14, wherein the reinforced adhesive material comprises at least one of a piece of reinforced tape material, a piece of reinforced polyethylene coated material, or a piece of reinforced thermoplastic material.

17. The method of claim 14, wherein scoring the material of the sleeve assembly further comprises the step of scoring the material to include a handle on the sleeve assembly.

18. The method of claim 17, wherein the handle is a cut-out that allows a handle connected to the package around which the sleeve assembly attaches, to operate freely.

19. The method of claim 14, wherein the fastener is at least one of a pin, tie, hook, or compression fastener.

20. The method of claim 14, wherein the fastening joint is at least one of a glue joint, thermal bonding material, or adhesive material.

* * * * *